US009589422B2

(12) United States Patent
Alexander

(10) Patent No.: US 9,589,422 B2
(45) Date of Patent: Mar. 7, 2017

(54) SYSTEM AND METHOD FOR CONDUCTING ON-LINE TOURNAMENT CONTEST

(71) Applicant: KIZZANG LLC, Las Vegas, NV (US)

(72) Inventor: Robert Alexander, Las Vegas, NV (US)

(73) Assignee: KIZZANG LLC, Las Vegas, CA (US)

( * ) Notice: Subject to any disclaimer, the term of this patent is extended or adjusted under 35 U.S.C. 154(b) by 28 days.

(21) Appl. No.: 14/206,827

(22) Filed: Mar. 12, 2014

(65) Prior Publication Data

US 2014/0274347 A1 Sep. 18, 2014

Related U.S. Application Data

(60) Provisional application No. 61/800,080, filed on Mar. 15, 2013, provisional application No. 61/895,782, filed on Oct. 25, 2013.

(51) Int. Cl.
*A63F 9/24* (2006.01)
*G07F 17/32* (2006.01)

(52) U.S. Cl.
CPC ..... *G07F 17/3276* (2013.01); *G07F 17/3244* (2013.01)

(58) Field of Classification Search
CPC . G07F 17/3276; G07F 17/3244; A63F 13/828
See application file for complete search history.

(56) References Cited

U.S. PATENT DOCUMENTS

2007/0293307 A1* 12/2007 DeRosa-Grund et al. ..... 463/25
2009/0005175 A1* 1/2009 Rosenau ..... G07F 17/32 463/43
2009/0171780 A1* 7/2009 Aldrey et al. ..... 705/14
2010/0312724 A1* 12/2010 Pinckney et al. ..... 706/11
2011/0034225 A1* 2/2011 Butz, Jr. ..... A63F 13/12 463/4

OTHER PUBLICATIONS

Lauren Hockenson, "March Madness: 6 Sites for Creating Your Ultimate Bracket", Mar. 9, 2012, https://web.archive.org/web/20120311043252/http://mashable.com/2012/03/09/march-madness-bracket-sites/.*
"March Madness Survior Pools for 2012" (hereinafter "Survival Pool"), Wayback Machine, Jan. 28, 2012, http://www.runyourpool.com/march-madness-survivor-pools.cfm.*
"March Madness: 6 Sites for Creating Your Ultimate Bracket" by Lauren Hockenson dated Mar. 9, 2012.*

* cited by examiner

*Primary Examiner* — James S McClellan
*Assistant Examiner* — Kevin Carter
(74) *Attorney, Agent, or Firm* — Ascenda Law Group, PC

(57) ABSTRACT

Systems and methods for conducting on-line tournaments, and in particular such tournaments as permit participants to receive prizes without having to place wagers. Participants are permitted to enroll in an on-line tournament pool and submit tokens. The tokens act as each respective participant's prediction regarding the outcome of one or more events associated with a sporting event or other contest. Tokens may be completed "brackets" representing a participant's prediction of winners of all games in various rounds of a sporting event, or partially completed brackets representing the participant's prediction of winners of only some games thereof. Cash prizes are awarded for top scoring participants but no wagers or entry fees of any kind are accepted from or required to be paid by the participants.

6 Claims, 4 Drawing Sheets

SYSTEM AND METHOD FOR CONDUCTING ON-LINE TOURNAMENT CONTEST

RELATED APPLICATIONS

This is a NONPROVISIONAL of, claims priority to and incorporates by reference (1) U.S. Provisional Application No. 61/800,080, filed Mar. 15, 2013, and (2) U.S. Provisional Application 61/895,782, filed Oct. 25, 2013.

FIELD OF THE INVENTION

The present invention relates to systems and methods for conducting on-line tournaments, and in particular such tournaments as permit participants to receive prizes without having to place wagers.

BACKGROUND

Sports wagering is an activity enjoyed by many and typically involves placing wagers on the outcome of one or more events, including but not limited to the final outcome of a subject match. In the United States, it is illegal for individuals or enterprises to engage in the business of assisting or facilitating the placing of such wagers over "wire communication facilities". Laws in this area have been generally interpreted as forbidding the use of Internet web sites (based in, or perhaps even accessible to persons residing in, the United States) for the purposes of sports betting.

There exist many different forms of bracket pools, each offering participants different ways to win. The most popular pool involves participants filling out brackets by trying to pick winners of different games at each stage of tournament play. Entry fees for such pools may vary from a few dollars to hundreds or even thousands of dollars, depending on the enterprise running the pool. The winner is generally the participant that picks the most correct winners, with final game score predictions often being used as tiebreakers. In one common variation of this pool, the points per win vary as the tournament progresses through different rounds.

In addition to the simple bracket pool other popular forms of tournament wagering schemes include bidding pools, where teams are auctioned off and awarded to the highest bidder, with the "owner" of the ultimate winning team them collecting all of the pool receipts. Lottery pools are sometimes used at intermediate rounds of the National College Athletics Association's (NCAA) Division I men's basketball tournament and involve participants drawing for lots then selecting teams in order of their lot values. This well-known sporting event (which culminates each year in the "Final Four" teams facing off against one another in a pair of national semi-final games and one national final game) is among the most watched and most heavily wagered upon event of its kind Each March (during the NCAA tournament), office bracket pools are commonplace and it has been estimated that the $100 Million or so that is earned by licensed casinos through wagers on the tournament games represents only a small fraction of the total amount of money spent by Americans on such activities.

Box pools, which are used with virtually all spots in wagering schemes, involve assigning participants to boxes on a grid (the two axes of the grid representing the two competing teams in a game) and then populating the grid with numbers (usually ranging from 0-9). The numbers represent the teams' respective scores (usually just the last number of the respective scores for a basketball game) and the winner is the participant that "owns" the box representing the final score (or a score at half-time, etc.).

A common feature of all of the above-described pools is that participants wager on the outcome. That is, participants agree to pay a certain amount of money (usually collected by the pool organizer as a condition for entry into the pool) for the privilege of being allowed to participate in the pool, with the hope of winning a prize depending on the outcome of the underlying game or set of games. As such, these pools would all be illegal in the United States if conducted over the Internet.

SUMMARY OF THE INVENTION

Methods and systems configured in accordance with embodiments of the present invention comply with restrictions placed on wagering over "wire communication facilities," while at the same time permitting participants to engage in activities that can result in the participants winning prizes depending on the outcome of sporting (or other) events.

BRIEF DESCRIPTION OF THE DRAWINGS

The present invention is illustrated by way of example, and not limitation, in the figures of the accompanying drawings, in which.

DETAILED DESCRIPTION

Described herein are systems and methods for conducting on-line tournaments, and in particular such tournaments as permit participants to receive prizes without having to place wagers. In one embodiment of the invention, participants are permitted to enroll in an on-line tournament and submit tokens. The tokens act as each respective participant's prediction regarding the outcome of one or more events associated with a sporting event or other contest. For example, tokens may be completed "brackets" representing a participant's prediction of winners of various games in various rounds of a basketball tournament.

The present invention avoids the above-described complications with bracket pools offered over the Internet by making participation in a pool completely free of charge. That is, participants are not required to pay any money for partaking in the pool. As such, the pool may be lawfully conducted through the facilities of an Internet web site and participants may enter into the pool over the Internet by visiting the site. At the same time, participants will be eligible for prizes (usually but not always necessarily) in the form of cash payments. In one embodiment, the cash payments are provided via a debit card issued to a winning participant by the operator of the Web site or a partner financial institution.

Figure 1:
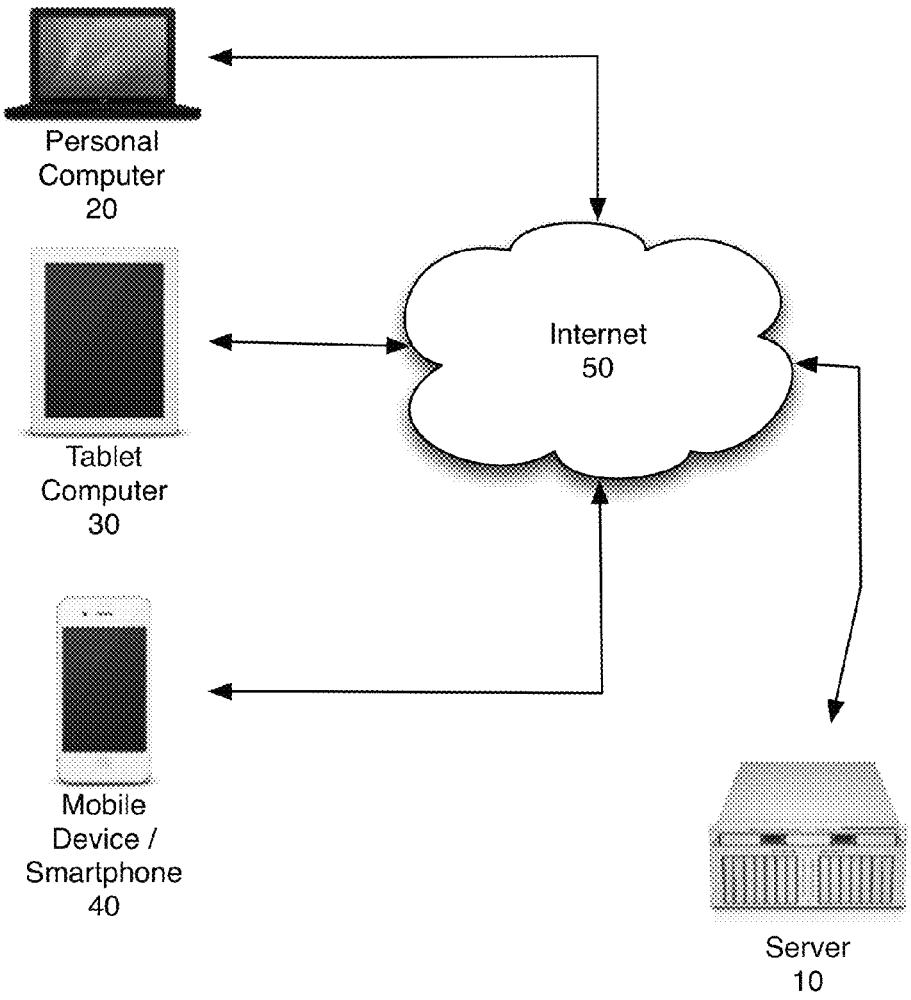
FIG. 1 illustrates an example of a system in which users may interact with a server hosting a web site configured to provide services in accordance with embodiments of the invention via any or all of personal computers, tablet computers and/or mobile devices/smartphones.

As shown in FIG. 1, users may interact with a server 10 hosting the subject Web site via any or all of personal computers 20, tablet computers 30 and/or mobile devices/smartphones 40. Such interaction may take place over any network or network of networks, such as the Internet 50. More generally, users may make use of the methods or processes described herein though or using various computer-based devices. Such devices may include any electronic device capable of performing the actions described herein (using suitable programming) and, where applicable, processing the information for display so as to properly convey the information to a user. Examples of such devices include desktop computers, laptop computers, cellphones, smartphones, tablet computers, computer game consoles, portable computer gaming consoles, media players, portable media players, other mobile devices, and the like.

To facilitate access by hundreds or even thousands of client devices (e.g., personal computers 20, tablet computers 30 and/or mobile devices/smartphones 40), server 10 may be a server farm with appropriate load balancers so as to provide each player with a satisfactory gaming experience that involves minimal latency. Instances of server 10 are configured by a tournament organizer to provide the same game to all players who participate in the tournament. Notification of the tournament, the tournament rules, playing conditions, etc., may be provided to individual players upon such players logging in to a respective account, through which the players may access the tournament if and when they choose to do so. For a player engaged in the tournament, his or her playing time will commence at a date and time of his or her own choosing within the defined tournament play period.

Figure 2:
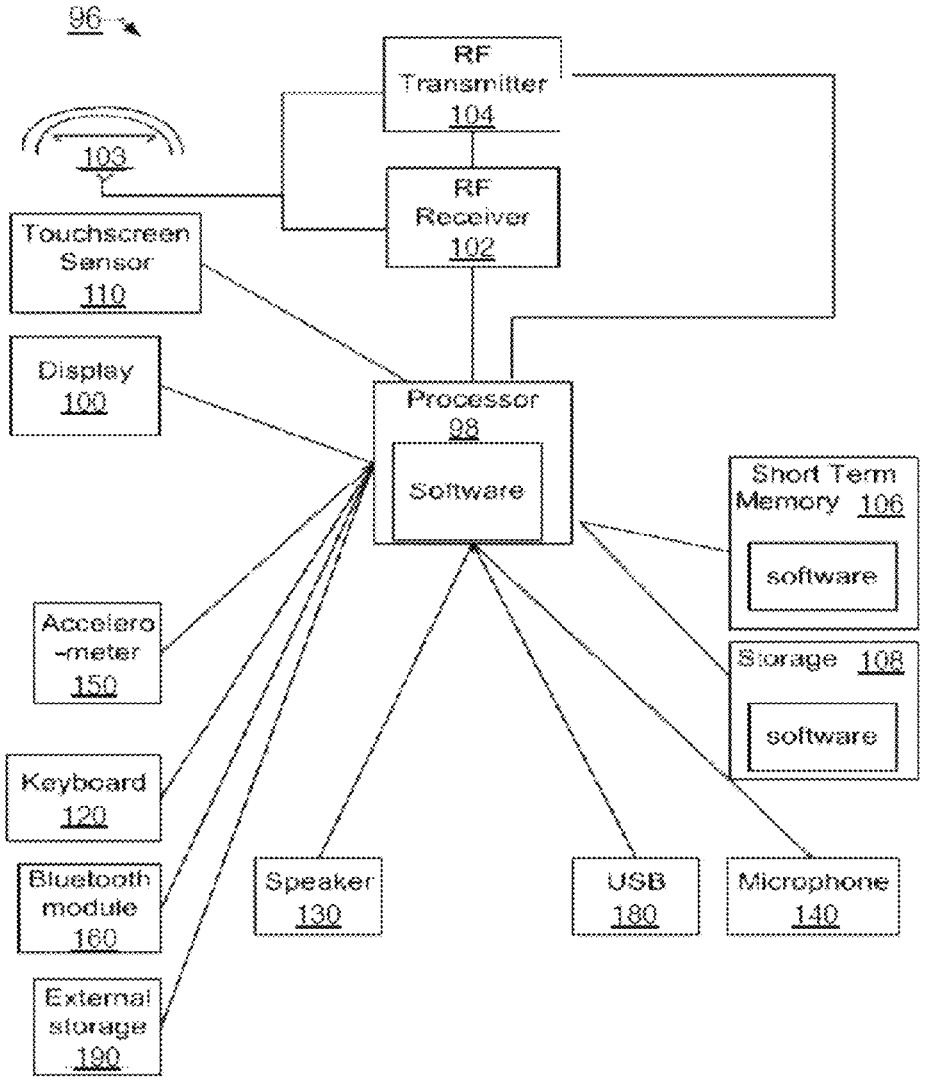
FIG. 2 illustrates an example of a client device which may be used to interact with a server hosting a web site configured to provide services in accordance with embodiments of the invention.

FIG. 2 shows one example of a client device 96 in the form of an electronic device. Processor 98 may control the overall functions of the electronic device such as running applications and controlling peripherals. Processor 98 may be any type of processor and may communicate with RF receiver 102 and RF transmitter 104 to transmit and receive wireless signals (e.g., via antenna 103) such as cellular, Bluetooth, Wi-Fi, WiLAN, or other communication signals. Processor 98 may use short-term memory 106 to store operating instructions and to help in the execution of the operating instructions (e.g., such as the temporary storage of calculations and the like). Processor 98 may also use non-transitory storage 108 to store and read instructions, files, and other data that requires long term, non-volatile storage.

Processor 98 may communicate and control other peripherals, such as display 100 with associated touch screen sensor 110. Processor 98 causes images to be displayed on display 100 and receives input from the touch screen sensor 110 when a user presses on the touch-screen display. In some examples, touch screen sensor 110 may be a multi-touch sensor capable of distinguishing and processing gestures.

Processor 98 may receive input from a physical keyboard 120. In other examples, the device 96 may utilize a touch screen keyboard using display 100 and touch screen sensor 110. Processor 98 may produce audio output and other alerts that are played on the speaker 130. Microphone 140 may be used as an input device for processor 98 to receive commands using voice-processing software.

Accelerometer 150 provides input on the motion of the device 96 to processor 98. Accelerometer 150 may be used in motion sensitive applications, or, for example, in connection with scrolling content using tilting gestures, etc. Bluetooth module 160 may be used to communicate with Bluetooth-enabled external devices. USB port 180 enables external connections to other devices (e.g., mice or other cursor control devices) supporting the USB standard and charging capabilities. USB port 180 may include all the functionality to connect to, and establish a connection with, an external device over USB. External storage module 190 may include any form of removable physical storage media such as a flash drive, micro SD card, SD card, Memory Stick, and the like. External storage module 190 may include all the functionality needed to interface with these media.

Certain embodiments are described herein as including logic or a number of components, modules, or mechanisms. Modules or components may constitute software modules (e.g., code embodied on a non-transitory machine-readable medium) or hardware-implemented modules. A hardware-implemented module is a tangible unit capable of performing certain operations and may be configured or arranged in a certain manner. In example embodiments, one or more computer systems (e.g., a standalone, client or server computer system) or one or more processors, including processor 98, may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry, or in temporarily configured circuitry (e.g., configured by software) may be driven by cost and time considerations.

Accordingly, the term "hardware-implemented module" should be understood to encompass a tangible entity, be that an entity that is physically constructed, permanently configured (e.g., hardwired) or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules may provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connects the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation, and store the output of that operation in a memory device to which it is communicatively coupled. A further hardware-implemented module may then, at a later time, access the memory device to retrieve and process the stored output. Hardware-implemented modules may also initiate communications with input or output devices, and may operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but also deployed across a number of machines. In some example embodiments, the processor or processors may be located in a single location, while in other embodiments the processors may be distributed across a number of locations.

The one or more processors may also operate to support performance of the relevant operations in a "cloud computing" environment or as a "software-as-a-service" (SaaS) service. For example, at least some of the operations may be performed by a group of computers (as examples of machines including processors), with these operations being accessible via a network (e.g., the Internet) and via one or more appropriate interfaces (e.g., Application Program Interfaces (APIs).)

Example embodiments may be implemented in digital electronic circuitry, or in computer hardware, firmware, software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program may be written in any form of programming language, including compiled or interpreted languages, and it may be deployed in any form, including as a stand-alone program or as a module, subroutine, or other unit suitable for use in a computing environment. A computer program may be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations may also be performed by, and apparatus of example embodiments may be implemented as, special purpose logic circuitry, e.g., a field programmable gate array (FPGA) or an application-specific integrated circuit (ASIC).

The computing system may include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that both hardware and software architectures require consideration. Specifically, it will be appreciated that the choice of whether to implement certain functionality in permanently configured hardware (e.g., an ASIC), in temporarily configured hardware (e.g., a combination of software and a programmable processor), or a combination of permanently and temporarily configured hardware may be a design choice. Below are set out hardware (e.g., machine) and software architectures that may be deployed, in various example embodiments.

Figure 3:
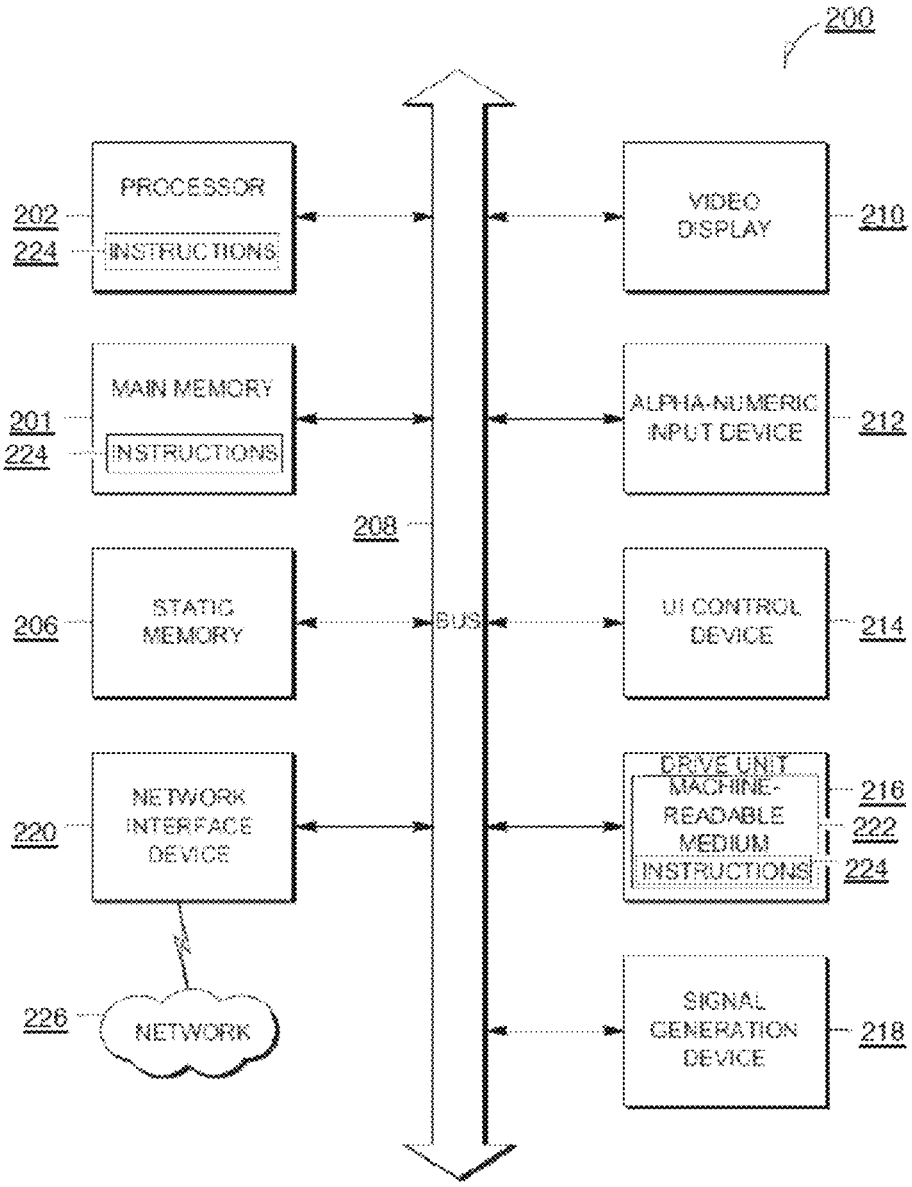
FIG. 3 illustrates an example of a server which may be configured for hosting a web site that provides services in accordance with embodiments of the invention.

FIG. 3 shows a diagrammatic representation of a machine in the example form of a computer system 200 within which a set of instructions for causing the machine to perform any one or more of the methods, processes, operations, or methodologies discussed herein may be executed. In some examples the computer system 200 may be client device 96 or include one or more of the components of client device 96. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a Personal Computer (PC), a tablet PC, a Set-Top Box (STB), a Personal Digital Assistant (PDA), a cellular telephone, a Web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Example embodiments may also be practiced in distributed system environments where local and remote computer systems that that are linked (e.g., either by hardwired, wireless, or a combination of hardwired and wireless connections) through a network, both perform tasks. In a distributed system environment, program modules may be located in both local and remote memory-storage devices (see below).

The example computer system 200 includes a processor 202 (e.g., a Central Processing Unit (CPU), a Graphics Processing Unit (GPU) or both), a main memory 201 and a static memory 206, which communicate with each other via a bus 208. The computer system 200 may further include a video display unit 210. The computer system 200 also includes an alphanumeric input device 212 (e.g., a keyboard), a User Interface (UI) controller 214 (e.g., a mouse), a disk drive unit 216, a signal generation device 218 (e.g., a speaker) and a network interface device 220 (e.g., a transmitter).

The disk drive unit 216 includes a machine-readable medium 222 on which is stored one or more sets of instructions 224 and data structures (e.g., software) embodying used by any one or more of the methodologies or functions illustrated herein. The software may also reside, completely or at least partially, within the main memory 201 and/or within the processor 202 during execution thereof by the computer system 200, with the main memory 201 and the processor 202 also constituting machine-readable media.

The instructions 224 may further be transmitted or received over a network 226 via the network interface device 220 using any one of a number of well-known transfer protocols (e.g., HTTP, Session Initiation Protocol (SIP)).

The term "machine-readable medium" should be taken to include a single medium or multiple media (e.g., a centralized or distributed database, and/or associated caches and servers) that store the one or more sets of instructions. The term "machine-readable medium" shall also be taken to include any non-transitory medium that is capable of storing, encoding, or carrying a set of instructions for execution by the machine and that cause the machine to perform any of the one or more of the methodologies illustrated herein. The term "machine-readable medium" shall accordingly be taken to include, but not be limited to, solid-state memories, and optical and magnetic medium.

Method embodiments discussed herein may be computer-implemented. Some embodiments may include computer-readable media encoded with a computer program (e.g., software), which includes instructions operable to cause an electronic device to perform methods of various embodiments. A software implementation (or computer-implemented method) may include microcode, assembly language code, or a higher-level language code, which further may include computer readable instructions for performing various methods. The code may form portions of computer program products. Further, the code may be tangibly stored on one or more volatile or non-volatile computer-readable media during execution or at other times. These computer-readable media may include, but are not limited to, hard disks, removable magnetic disks, removable optical disks (e.g., compact disks and digital video disks), magnetic cassettes, memory cards or sticks, Random Access Memories (RAMs), Read Only Memories (ROMs), and the like.

As indicated above, participants do not need to pay to enter the on-line pools hosted at the Web site running on server 10. Instead, funding for the Web site operations may be provided through secondary means, for example the sale of advertising. Thus, participants may be required to view one or more advertisements before they are allowed to participate in games or pools provided at the subject Web site and the advertisers may pay the site operators in exchange for presenting their ads. In other embodiments, funding may be provided through alternative means. For example, participants may agree to receive marketing materials (other then just on-line advertisements) of site sponsors in exchange for being permitted to play games and/or participate in pools. Those sponsors may pay the site operators for facilitating such delivery of the marketing materials.

In a particular embodiment of the invention, the web site is preferentially accessed through one or more applications running on a mobile phone. This may be one or more special purpose applications designed to call particular application programming interfaces exposed via the subject Web site to facilitate efficient exchanges of information there between, and/or it may be a web browser running on the mobile phone and access may be made in the fashion common to such browsers. The site operators may provide the mobile phone to the participants free of charge. That is, participants may receive the mobile phones as gifts (without any obligation to purchase service contracts or pay for any use of the phone for voice, data, text, or other services), and in exchange may be presented with (and agree to receive) advertising information through the mobile phones. Unlike current plans offered by wireless service carriers that require mobile phone users to subscribe to a network for a particular length of time in order to receive a reduced fee (or even free) mobile phone, the present inventor contemplates providing participants with mobile phone completely free of any such requirements. By providing exceptional content (e.g., the gaming activities) and customer service, the inventor believes that participant loyalty can be maintained. Further, advertisers seeking to gain the attention of the participants should be willing to pay the site operator for having the operator present their ads to the participants via the mobile phones. Even wireless service carriers may be willing to provide reduced cost access to their networks in exchange for bulk purchases of airtime and data transport by the site operator. Thus, the mobile phones are provided to the users completely free of charge, without any service contract obligations or other restrictions. Content delivered to the phone, however, is restricted to that which the provider wishes to provide.

Among the various game content that may be provided by the site operator are traditional casino games (e.g., blackjack, baccarat, craps, poker, slots, progressive slots, keno, etc.), the pool contests discussed above, lotteries, role playing games, first person shooter games, strategy games, etc. Some or all of these games may offer cash prizes to winners, with the funds for such prizes coming from the fees paid by advertisers and/or insurance policies. In the latter case, insurance policies may be purchased by the site operators to guard against the risk of a winner of a substantial cash prize. An example of such a cash prize is discussed further below. In addition to games, other facilities such as Internet search, music and audio/video services, text messaging, etc. can all be facilitated through channels controlled by the site operator. This ensures both a consistent user experience and quality of service as well as guarantying advertisers access to the participants.

To access the subject Web site, participants may be required to register. The registration process may include providing personal information such as names, dates of birth, social security number (for tax reporting purposes in respect of significant prize awards), driver's license numbers, etc. As part of the registration process, participants may be permitted to select unique user name/password combinations so as to be able to identify themselves during return visits to the subject site. When the site is accessed via dedicated apps on a mobile device, the same user name/password combinations may be employed as identification means. In some instances, personally identifying information of a participant may, subject to participant authorization, be provided to sponsors of the subject Web site for lead generation purposes. In other instances, the site may include logic that parses the participant's personal information, develops participant profiles based on same, and then recommends to each participant one or more sponsors' advertising or other materials based on that profile. In still further instances, the site may include logic that, based on the participant information, crawls one or more social network sites to identify existing personal profiles of the participants and uses those social network profiles as the basis for making recommendations.

Upon registration, participants will be verified. This may be done, for example through the use of state department of motor vehicle records, credit reports, utility company bills, state or county property records, etc. Verification is important to ensure that minors are not permitted access to any restricted materials or games at or through the site (or the mobile phone if so provided by the site operators). Users that cannot be verified may not be permitted access to the site, or may be permitted only limited access, which prevents such participants from accessing any age-restricted materials, etc.

As an example of the gaming facilities provided through the subject web site, consider a form of bracket pool that may be offered during a basketball tournament. Importantly, entry into the pool is free to the participant. No cash wagers are required or permitted. Cash prizes are, however, available to winners and may be financed through funds received from advertisers and, in some instances, insurance policies.

Participants in the pool are permitted to fill out and submit traditional brackets. Prior to submitting the brackets, however, participants are required to view one or more advertisements. Alternatively, advertisements (e.g., in the form of banner ads, etc.) may be presented to the participants as they are filling out the brackets or participating in other activities at the subject Web site. Completed brackets must be submitted before tipoff of the opening game of the tournament and/or in accordance with time windows described below. In the case where not all teams are known prior to the commencement of the first game (e.g., for tournaments having a "play-your-way-in" round), options may be provided for participants to select either or both teams playing in such a game so as to permit completion of an entire bracket. Alternatively, the "win-and-you're-in" team may be automatically populated into the bracket once known and participants provided a bye for such rounds. In the event the participant wishes to designate that team as advancing in the tournament by winning a first, second or other round game (following the play-your-way-in round) the brackets (which are completed electronically) may provide for designating the team by proxy, if not by name.

As an incentive to entice participation in the pool, a substantial cash prize (e.g., on the order of millions or even tens of millions of dollars) may be offered for a "perfect bracket;" that is, a correct selection of all winners of all games during the entire tournament. An additional bonus may be offered for predicting the final score of the championship game. Special insurance products may be purchased by the site operators to guard against the risk of a winner of this prize.

Of course, prizes are not just awarded for a perfect bracket and instead may be awarded at each level of play during the tournament. For example, a first "game" may involve the first and second rounds of the tournament (following the play-your-way-in round), where the field of teams is reduced first from 64 to 32 and then from 32 to 16 (the "sweet sixteen"). At this level, prizes may be awarded based on points (with pints being accumulated for correctly predicted winning teams), game scores, or other factors.

At the next level of the tournament, the regional semi-finals and finals, where the remaining 16 teams play down to the "elite eight" and then to the "final four", the originally submitted brackets may again serve as the basis for awarding prizes. For example, prizes may again be awarded based on point totals after one or both of these rounds of play. In addition, a new "beat the spread" game may be offered for these rounds of play, wherein participants are given the opportunity to complete new brackets, this time composed of just the remaining 16 teams. Along with the teams, participants may be provided point spreads composes by one or more odds makers, and the object of the new pool is to beat the spread either by picking the winning team to win by a margin greater than the point spread, or to pick the losing team to lose by less than the predicted point spread. Participants may again enter this new pool free of charge with the expectation of winning cash prizes, e.g., in exchange for agreeing to and actually watching advertisements.

In all of the embodiments discussed herein, a participant's actual attention to an advertisement may be measured by requiring the participant to engage with the advertisement (or another on-screen or audio prompt) at some point. For example, if the advertisement is an audio-video presentation, the participant may be required to press a play button to resume playing of a paused video within a predetermined time interval (probably a few seconds). If the participant does not execute such an operation, that may be taken as an indication that the participant is not actively watching the advertisements and the participant will not be given credit for same and will not be permitted to submit a bracket. In the case of other forms of advertising, different attention monitoring means may be employed. For example, a user may have to press a touch screen in a particular location on a graphical image in order to signify his or her active reviewing of the ad. Other attention monitoring means may also be used.

Still further prizes may be offered during the final rounds of the tournament when the final four teams play for the national championship. For example, while the originally completed brackets may still be used and winners chosen (e.g., based on total points accumulated for correctly picking winning teams), a new pool that focuses on the game scores during the semi-finals and finals may be instituted. In this pool, participants are asked to select the final score of each game of the last three games of the tournament. The winner is the person that has the correct three scores (or closest thereto based upon some predetermined metric for computing a closest approximation). Again, no cash wagers are permitted, no entry fees are charged, but winners are competing for cash prizes and agree to watch or receive advertising as a condition for entering the pool.

Some or all of the cash prizes discussed herein may be distributed to winners in the form of debit cards with linked accounts at a partner financial institution. Taxes may be deducted before any winnings are distributed in this fashion. The debit cards may be uniquely identified with the prize winning participants and once distributed the underlying accounts may be used to receive future winnings from games associated with the subject Web site.

In some embodiments, the present invention allows players to participate in on-line pools devised around start and end dates and times of their own choosing. In one embodiment, an on-line pool is organized and players are permitted to enter, specifying start and end dates and times of their own choosing within a predefined pool window. For example, a pool may be scheduled to run over the defined pool window of a scheduled basketball tournament (say January 1 to January 30), but a participant may elect to participate only in those games of the tournament that take place during the period from 10:00 AM Eastern Standard Time, January 1 through 10:00 PM Eastern Standard Time, January 10, by submitting tokens accordingly. More generally, a player may compete in a pool having a fixed pool period, $t_{play}$, but only for those games within the pool that occur within player-specified date/time boundaries, $t_{start}$ and $t_{end}$. The winners then are those players who attains a highest (or lowest in games where lower scores are deemed to be better than higher scores) score (and here a score may be determined in any of a variety of ways, for example, in terms of points, dollars, or other markers indicative of successful game play and/or performance) during the defined periods of the pool. In some instances, players may be permitted to play multiple tokens of this type during a pool (each playing session lasting for a defined period within $t_{play}$), while in other cases players may be permitted only a single token per pool. Some pools may have only a single winner, while other pools may award prizes for multiple placings by players (e.g., first place, second place, third place, etc.). Rules of each pool may vary depending on the game being played.

Figure 4:
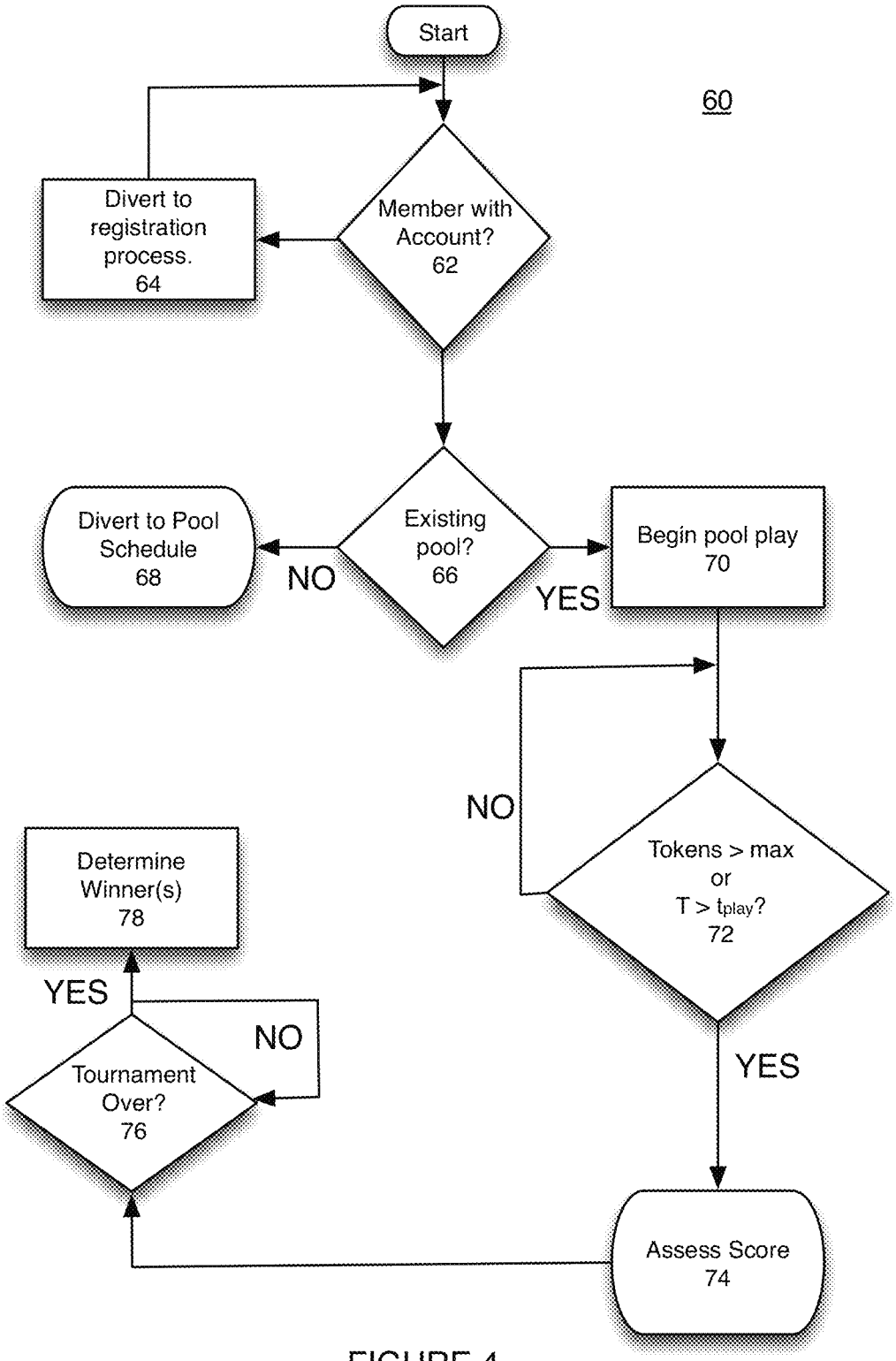
FIG. 4 illustrates a process for operating an on-line pool in accordance with one embodiment of the present invention.

FIG. 4 shows an example of such a process 60 executed by server 10 when a player at a client 20, 30, 40 connects to the server. At 62, the server may execute a process to determine whether the player is a member that has an account with the service. This may be done by running a log-in or similar script that requires the user to enter log-in credentials for the service. If the player is not a member of the tournament service, the player may be diverted to a registration process 64, which provides the player with an opportunity to become a member. This may involve the player providing certain personal information, including, for example, information sufficient to establish that the player is of legal age to play in pools of the kind offered through the service. Although shown as an in-line process, obtaining membership in the service may be a separate process that requires some time to complete, as for example where verification of the member's age, etc. is required through secondary sources.

If the server determines that the player is a member of the service 62, the server determines whether there is an existing pool opportunity in progress 66. This is essentially a check of whether the time for a pool selected by the player is within the period $t_{play}$. If not, the player may be diverted to a schedule 68 that provides information regarding upcoming pool dates/times. If, however, the player's desired pool has commenced, the player is provided an opportunity to begin play 70.

The server then permits the player to participate by submitting one or more (depending on the rules) pool tokens. In the case of a basketball tournament, the tokens may be brackets. AS indicated above, the brackets may be for the entire set of games that comprise the tournament to which the pool is directed, or may be for a subset of those games defined by $t_{start}$ and $t_{end}$. Tokens are permitted, according to the rules, up to a maximum number of tokens (which may be a daily or other limit) or the expiration of the time $t_{play}$ 72. Upon completion, game play is concluded and the payer's score is determined as the underlying games in the tournament are completed 74. Upon completion of the tournament 76, the server determines the winner 78 (e.g., the player(s) with the highest score(s)) and the winning player (s) is/are so notified. Optionally, player results may be posted in a player's account or other venue where the player can review his/her own scores and, optionally, scores of other players.

Preferably, the server 10 logs information concerning a number of aspects of the pool. For example, logs that indicate which players participated in a pool, when, how often and for how long at a time are kept. So too are logs of all player scores, pool tokens, etc. Logs that record technical faults, communication problems, etc. that may become the subject of a complaint or may be grounds for providing repeat play opportunities are also kept.

Thus, systems and methods for conducting on-line pools, and in particular such pools as permit participants to receive prizes without having to place wagers, have been described. It is an important feature of the present invention that no participant is required, or permitted, to place wagers on any of the sports activities that are the underlying subject of the pools facilitated through the subject Web site. Nor are wagers required or permitted in connection with any of the other games (e.g., casino games, etc.). All participants are allowed to play in the pools and games free of charge. Operating costs and, in some instances prizes, are funded through sales of advertising, which participants agree to watch or otherwise interact with as a condition for entering a pool and/or playing a game. In various embodiments, cash prizes may be provide to winners through debit cards provided by a partner financial institution. In still further embodiments, participants may be provided mobile phones free of charge, with the entire cost of the phone and any voice, data and text plans underwritten by the fees charged by the site operator to advertisers. Content delivered or made available through such a mobile phone (in addition to the games and pools discussed above) takes the form of a walled garden, determined by the site operator (or other content provider) and includes the advertiser/sponsor content. The foregoing description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplate examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

What is claimed is:

1. A system, comprising a server having a processor and a memory, the server communicably coupled to a network, the memory storing computer-executable instructions, which instructions when executed by the processor cause the processor to configure the server as a web site host that permits participants to enter tournament pools concerning outcomes of games and to receive cash prizes for participation in the tournament pools without having to place wagers, wherein the server is configured to enroll the participants in the tournament pools and accept tokens from the participants, wherein the tokens represent each respective participant's prediction regarding an outcome of one or more games associated with the tournament pool, wherein the tokens comprise completed brackets representing each respective participant's prediction of winners of various games in various rounds of a tournament pool and the tokens are for at least one of the entire set of games that comprise the tournament pool and a subset of those games, each respective participant selects the number of games associated with the tournament pool for which they will predict the outcome, and each respective participant chooses a start and end time of the tournament pool for which they predict the outcome, wherein the server is further configured to provide an advertisement to the user along with an attention monitoring means configured to monitor the user's attention to the provided advertisement, wherein acceptance of the tokens is dependent upon the user's interaction with the attention monitoring means.

2. The system of claim 1, wherein a plurality of the tokens comprise brackets representing a respective plurality of participant's prediction of winners of fewer than all games in fewer than all rounds of the game.

3. The system of claim 1, wherein enrolling the participants comprises permitting the participants to register with a service offering the tournament pool and verifying registration information provided by each participant.

4. The system of claim 3, wherein enrolling the participants further comprises parsing each respective participant's personal information, developing respective participant profiles based on the respective participant's personal information, and then recommending to each respective participant one or more sponsors' advertising or other materials based on the respective participant's profile.

5. The system of claim 4, wherein enrolling the participants further comprises, using the respective participant's personal information, crawling one or more social network sites to identify existing social network profiles of the respective participant and using the identified social network profiles of the respective participant as a basis for making recommendations regarding the sponsors' advertising or other materials.

6. The system of claim 1, wherein the cash prizes comprise prizes for a perfect bracket and for high scores associated with multiple rounds of respective games.

* * * * *